United States Patent [19]

Marshall et al.

[11] 4,129,507

[45] Dec. 12, 1978

[54] SPIN FINISH FOR POLYAMIDE YARN

[75] Inventors: Robert M. Marshall; Sung K. Pak, both of Chester; Kimon C. Dardoufas, Richmond, all of Va.

[73] Assignee: Allied Chemical Corporation, Morris Township, Morris County, N.J.

[21] Appl. No.: 870,306

[22] Filed: Jan. 18, 1978

[51] Int. Cl.[2] ..... D06M 13/10

[52] U.S. Cl. ..... 252/8.9; 8/115.6; 252/8.7; 428/395

[58] Field of Search ..... 252/8.9, 8.7, 8.75, 252/8.8, 52 R, 56 D; 428/395; 8/115.6

[56] References Cited

U.S. PATENT DOCUMENTS

| | | | |
|---|---|---|---|
| 3,056,744 | 10/1962 | Copes et al. | 252/8.8 |
| 3,060,163 | 10/1962 | Erchak | 260/94.9 |
| 3,103,448 | 9/1963 | Ross | 8/115.6 |
| 3,428,560 | 2/1969 | Olsen | 252/8.75 |
| 3,442,694 | 5/1969 | Sookne et al. | 428/267 |
| 3,475,207 | 10/1969 | Berch et al. | 427/392 |
| 3,560,382 | 2/1971 | Finch | 252/8.9 |
| 3,917,893 | 11/1975 | Marshall et al. | 428/395 |

*Primary Examiner*—William E. Schulz
*Attorney, Agent, or Firm*—Fred L. Kelly

[57] ABSTRACT

An improved spin finish particularly for polyamide yarn to be processed into tire cord, comprising an oil in water emulsion, said oil portion consisting essentially of specified proportions of an oxidized polyethylene wax, a white mineral oil having a viscosity of 300 to 500 S.U.S. at 100° F., a polyoxyethylene oleyl phosphate, and a sulfonated succinic acid ester of decyl alcohol, said oil in water emulsion being adjusted to pH 7.1 to 8.0 with sodium hydroxide.

10 Claims, No Drawings

SPIN FINISH FOR POLYAMIDE YARN

BACKGROUND OF THE INVENTION

This invention relates to a yarn finish. More particularly, this invention relates to a spin finish for polyamide yarn to be processed into tire cord.

Various finishes for synthetic filaments are known. However, none of the prior art teaches the required combination of ingredients to achieve the specific beneficial results of the composition of this invention. The critical ingredients and amounts thereof are shown in the discussion below.

Many of the known finishes flash off of the yarn in high temperature processing. Others cause excessive loss of strength during cording operations. Still others fail to have emulsion stability or provide insufficient yarn lubrication. Representative prior art patents include U.S. Pat. No. 3,103,448 to Ross; U.S. Pat. No. 3,428,560 to Olsen; U.S. Pat. No. 3,560,382 to Finch; U.S. Pat. No. 3,575,856 to Anton; and U.S. Pat. No. 3,644,081 to Matsuda et al.

It has been suggested that an oxidized polyethylene wax mixed with mineral oil and a suitable emulsifier may be emulsified with water so as to minimize the quantity of lubricant required and provide an unusually even distribution of finish on the yarn. For example, our recent U.S. Pat. No. 3,917,893 discloses a spin finish for polyamide yarn comprising an oil in water emulsion, the oil portion consisting essentially of white mineral oil, an oxidized polyethylene wax, an ethoxylated phosphated oleyl alcohol and a sulfonated succinic acid ester of oleyl alcohol.

Although the spin finish disclosed in U.S. Pat. No. 3,917,893 is an important contribution to this art, its use on polyamide tire yarn has led to serious problems. More particularly, in production of tire cord from polyamide yarn bearing the spin finish of said patent, difficulty has been experienced in that the yarn suffers a significant loss of strength. Moreover, the finish tends to "smoke", i.e., give off fumes, when processed at the high temperature required for the cording operation. In production of tire cord, the tire yarn is conventionally twisted into three-ply cords and prepared for tire application by treatment with a standard resorcinol-formaldehyde-latex dip followed by heat treatment. The strength retained after this treatment is important to the quality of the resulting tires.

SUMMARY OF THE INVENTION

It is a primary object of the present invention to provide a spin finish for polyamide yarn to be processed into tire cord.

It is another object of the present invention to provide a spin finish for polyamide yarn to be processed into tire cord by conventional cording operations involving high temperature.

It is a further object of this invention to provide a spin finish for polyamide yarn, which has excellent stability to high temperature processing conditions and also provides lubrication, static protection and plasticity to the yarn.

These and other objects of this invention are provided by a finish of an oil in water emulsion of about 10 to 25 percent by weight of the oil portion. The oil portion consists essentially of 5 to 10 parts by weight of an oxidized polyethylene wax having an average molecular weight between about 1,000 and about 3,000 and containing 3 to 9 percent of oxygen by weight; 30 to 60 parts by weight of white mineral oil having a viscosity of 300 to 500 S.U.S. (Saybolt universal seconds) at 100° F.; 25 to 50 parts by weight of a polyoxyethylene oleyl phosphate; and 2 to 10 parts by weight of a sulfonated succinic acid ester of decyl alcohol, said oil in water emulsion being adjusted to pH 7.1 to 8.0 with sodium hydroxide.

Since very little of this finish flashes off in high temperature processing, about 0.5 to 1.2 percent by weight of yarn, of oil is applied as spin finish, and about 0.5 to 1.2 percent by weight of yarn, of oil remains on the yarn after high temperature processing.

Oxidized polyethylene wax materials suitable for use in the present invention are described in U.S. Pat. No. 3,060,163 according to which normally solid, hard, waxy polymers of ethylene, which are saturated aliphatic compounds characterized by a recurring $-CH_2-$ group and which have average molecular weights between about 1,000 and about 3,000 especially polyethylene/alkanol telomers of this character, are subjected, in the liquid phase, to the action of an oxygen-containing gas to cause reaction of at least about 5 pounds of oxygen per 100 pounds of wax, desirably between about 5 pounds and about 17 pounds of oxygen, per 100 pounds of wax, i.e., to provide an oxidized polyethylene wax containing at least about 3 percent, desirably between about 3 percent and about 9 percent of oxygen by weight, based on the weight of the oxidized wax, and acid numbers of not more than about 50, preferably between about 10 and about 45. The oxidized polyethylene/isopropanol telomer waxes prepared according to the above method containing between about 3 percent and about 6 percent oxygen and having average molecular weights between about 1,000 and about 3,000, melting points between about 90° C. and about 110° C., acid numbers between about 10 and about 20, are especially preferred. The preferred oxidized wax products are characterized by an extremely low incidence of, or in many cases, substantially complete absence of ester groups. Thus, the saponification number (which measures both acid and ester groups) is substantially identical to or only slightly greater than the acid number (which measures only acid groups) so that these products all have an extremely low or zero ester number (saponification number minus acid number) and have ratios of saponification number to acid number of about 1 to about 1.2 and not more than about 1.5.

The waxy ethylene polymers which are oxidized as above described, may themselves be prepared by any suitable known methods, for example by subjecting ethylene, either alone or in the presence of a co-reactant, to temperatures between about 150° C. and about 300° C. and pressures ranging from about 500 p.s.i. to about 7,000 p.s.i. as disclosed in U.S. Pat. Nos. 2,683,141 and 2,504,400.

DESCRIPTION OF THE PREFERRED EMBODIMENT

The preferred embodiment of this invention may be briefly stated as follows: A spin finish particuarly for continuous filament polyamide yarn to be processed into twist plied tire cord, said finish being an oil in water emulsion of about 15 to 20 percent by weight of said oil portion, said oil portion consisting essentially of about 5 to 7 parts by weight of an oxidized polyethylene wax having an average molecular weight between about 1,000 and about 3,000 and containing 3 to 9 percent of oxygen by weight; about 43 to 50 parts by weight of white mineral oil having a viscosity of 350 to 400 S.U.S. at 100° F.; about 42 to 45 parts by weight of a polyoxyethylene oleyl phosphate; and about 2 to 3 parts by weight of a sulfonated succinic acid ester of decyl alcohol, said oil in water emulsion being adjusted to about pH 7.4 to 7.6 with sodium hydroxide. Preferably, the polyoxyethylene oleyl phosphate contains about 5 to 9 moles of ethylene oxide per mole of polyoxyethylene oleyl phosphate.

Table I shows a particularly preferred finish composition of the present invention. Table II shows the criticality of the specified ingredients necessary to provide a stable emulsion. Note that only the finish identified as A provides excellent emulsion stability after 48 hours. Varying the components or the amounts of the various components results in only fair or poor emulsion stability. The white mineral oil used in these tests had a boiling point of 370° C. and a viscosity of 375 S.U.S. (Saybolt Universal seconds) at 100° F. (37.8° C.); the oxidized polyethylene wax had an average molecular weight between about 1,000 and 3,000 and contained between 3 percent and 9 percent oxygen by weight.

TABLE I

| Finish Composition | |
|---|---|
| FInish Components | Parts by Weight |
| White Mineral Oil | 47 |
| Oxidized Polyethylene Wax | 6 |
| Sulfonated Decyl Alcohol Ester of Succinic Acid | 2 |
| Polyoxyethylene (7)[a]Oleyl Phosphate | 45 |
| Sodium Hydroxide[b] | 0.25 |

[a]Moles of ethylene oxide per mole of base material.
[b]Emulsion prepared by mixing 100 parts by weight of oil portion, 400 parts by weight of water and 0.25 part by weight NaOH to adjust the pH of the emulsion to 7.5.

EXAMPLE 1

A reactor equipped with a heater and stirrer is charged with a mixture of 1,520 parts of epsilon-caprolactam and 80 parts of aminocaproic acid. The mixture is then flushed with nitrogen and stirred and heated to 255° C. over a 1-hour period at atmospheric pressure to produce a polymerization reaction. The heating and stirring is continued at atmospheric pressure under a nitrogen sweep for an additional 4 hours in order to complete the polymerization. Nitrogen is then admitted to the reactor and a small pressure is maintained while the polycaproamide polymer is extruded from the reactor in the form of a polymer ribbon. The polymer ribbon is subsequently cooled, pelletized, washed and dried. The polymer is a white solid having a relative viscosity of about 50 to 60 as determined at a concentration of 11 grams of polymer in 100 ml. of 90 percent formic acid at 25° C. (ASTM D-789-62T).

The polymer pellets are melted at about 285° C. and melt extruded under pressure of about 1,500 psig. through a 204-orifice spinnerette to produce an undrawn yarn having about 6,300 denier. The finish composition of Table I, above, is applied to the yarn as a spin finish in amount to provide about 1.0 percent oil on the yarn. The yarn is then heated and drawn over a ceramic pin on a conventional draw-twist machine to about 5 times its extruded length to produce a 1,260-denier yarn. The filaments attain a temperature of about 180° C. during the drawing operation. The finishing composition on the yarn shows no signs of decomposition and is completely stable at the temperature employed. For convenience, this yarn is called Yarn A.

A control yarn is then prepared in the same manner except that the spin finish of Example 1 of U.S. Pat. No. 3,917,893 is employed instead of the finish of the present invention. For convenience, this control yarn is called Yarn B. During the drawing of this control yarn, offensive smoke and fumes are given off.

TABLE II

| FINISH COMPOSITIONS | | | | | | | | | | | |
|---|---|---|---|---|---|---|---|---|---|---|---|
| | Parts by Weight | | | | | | | | | | |
| Finish Components | A | B | C | D | E | F | G | H | I | J | K |
| White Mineral Oil | 47 | 47 | 47 | 47 | 47 | 43 | 41 | 50 | 53 | 47 | 47 |
| Oxidized Polyethylene Wax | 6 | 6 | 6 | 6 | 6 | 10 | 12 | 6 | 6 | 6 | 6 |
| Sulfonated Decyl Alcohol Ester of Succinic Acid | 2 | 2 | 2 | 2 | 2 | 2 | 2 | 2 | 2 | 3 | 4 |
| Polyoxyethylene (7)[a] Oleyl Phosphate | 45 | — | — | — | — | 45 | 45 | 42 | 39 | 44 | 43 |
| Sodium Hydroxide[b] | 0.25 | 0.25 | 0.25 | 0.25 | 0.25 | 0.25 | 0.25 | 0.25 | 0.25 | 0.25 | 0.25 |
| Polyoxyethylene (9)[a] Oleyl Phosphate | — | 45 | — | — | — | — | — | — | — | — | — |
| Polyoxyethylene (7)[a] Lauryl Phosphate | — | — | 45 | — | — | — | — | — | — | — | — |
| Polyoxyethylene (7)[a] Stearyl Phosphate | — | — | — | 45 | — | — | — | — | — | — | — |
| Polyoxyethylene (3)[a] Stearyl Phosphate | — | — | — | — | 45 | — | — | — | — | — | — |
| Emulsion Stability* After 48 Hours (Emulsion Contains 20 Percent by Weight of Oil Portion in Water) | E | F | P | P | P | F | P | F | P | F | P |

[a]Moles of ethylene oxide per mole of base material.
[b]Emulsion prepared by mixing 100 parts by weight of oil portion, 400 parts by weight of water and 0.25 part by weight NaOH to adjust the pH of the emulsion to 7.5.
*E = Excellent - Translucent bluish-white; particle size less than 1 micron. No separation.
*F = Fair - Milky white; particle size up to 4 microns. Slight ring of oil separation on surface.
*P = Poor - Chalky white; particle size above 4 microns. Creaming on surface.

The invention will now be further described in the following specific examples which are to be regarded solely as illustrative and not as restricting the scope of the invention. In the following examples, parts and percentages employed are by weight unless otherwise indicated.

Yarn A and Yarn B are separately twisted into three-ply cords and prepared for tire application by treatment with a standard resorcinol-formaldehyde-latex dip and processing at high temperature (200°-205° C.) in the conventional manner. The twisted cords are tested before and after treatment by a method described in ASTM D885-75, Section 15, in order to determine the breaking strength retained which is important to the quality of tires produced from the cords. Breaking strength retained after dip treatment of the tire cords is shown below.

| | Breaking strength retained, percent |
|---|---|
| Cord from Yarn A | 100 |
| Cord from Yarn B | 90 |

The dramatic increase in breaking strength retained for the cord made from Yarn A is highly significant since the individual standard deviation of the test is less than 1 percent.

EXAMPLE 2 (Comparative)

The procedure of Example 1 is repeated except that the oxidized polyethylene wax component of the spin finish is omitted. The resulting yarn is called Yarn C. The breaking strength retained after dip treatment of tire cord made from Yarn C is only 89 percent.

EXAMPLE 3 (Comparative)

The procedure of Example 1 is repeated except that the sodium hydroxide component of the finish is omitted. The resulting yarn is called Yarn D. The breaking strength retained after dip treatment of tire cord made from Yarn D is only 90 percent.

EXAMPLE 4

The procedure of Example 1 is repeated except that the sulfonated decyl alcohol ester of succinic acid is replaced with an equal amount of the sulfonated oleyl alcohol ester of succinic acid, which is the preferred succinic acid ester disclosed in U.S. Pat. No. 3,917,893. Surprisingly, the resulting finish has poor emulsion stability. Apparently, the higher boiling white mineral oil used in the spin finish of the present invention changes the finish significantly from that of U.S. Pat. No. 3,917,893, so that the preferred succinic acid ester of said patent is not effective for use in the present invention.

DISCUSSION

Although the spin finish of the present invention is particularly critical for yarn to be used in preparing tire cord, it also provides many other benefits. The following is a list of additional benefits of the finish composition of this invention:

1. The finish is nonfuming, i.e., it does not flash off in high temperature processing.
2. The finish has emulsion stability.
3. The finish lubricates the yarn even after passing through high temperature processing.
4. An even distribution of the finish on the yarn is achieved.
5. The finish prevents static buildup.
6. Plasticity is imparted to the yarn.

We claim:

1. A spin finish particularly for continuous filament polyamide yarn to be processed into twist plied tire cord, said finish being an oil in water emulsion of about 10 to 25 percent by weight of said oil portion, said oil portion consisting essentially of 5 to 10 parts by weight of an oxidized polyethylene wax having an average molecular weight between about 1,000 and about 3,000 and containing 3 to 9 percent of oxygen by weight; 30 to 60 parts by weight of white mineral oil having a viscosity of 300 to 500 S.U.S. at 100° F.; 25 to 50 parts by weight of a polyoxyethylene oleyl phosphate; and 2 to 10 parts by weight of a sulfonated succinic acid ester of decyl alcohol, said oil in water emulsion being adjusted to pH 7.1 to 8.0 with sodium hydroxide.

2. The spin finish of claim 1 wherein the white mineral oil has a viscosity of 350 to 400 S.U.S. at 100° F.

3. The spin finish of claim 1 wherein the polyoxyethylene oleyl phosphate contains about 5 to 9 moles of ethylene oxide per mole of polyoxyethylene oleyl phosphate.

4. The spin finish of claim 1 wherein the oil in water emulsion contains about 15 to 20 percent by weight of said oil portion.

5. A continuous filament polyamide yarn having a coating thereon of the spin finish of claim 1, about 0.5 to 1.2 percent by weight of yarn, of said oil in said finish being applied to said yarn.

6. A spin finish particularly for continuous filament polyamide yarn to be processed into twist plied tire cord, said finish being an oil in water emulsion of about 15 to 20 percent by weight of said oil portion, said oil portion consisting essentially of about 5 to 7 parts by weight of an oxidized polyethylene wax having an average molecular weight between about 1,000 and about 3,000 and containing 3 to 9 percent of oxygen by weight; about 43–50 parts by weight of white mineral oil having a viscosity of 350 to 400 S.U.S. at 100° F.; about 42 to 45 parts by weight of a polyoxyethylene oleyl phosphate; and about 2 to 3 parts by weight of a sulfonated succinic acid ester of decyl alcohol, said oil in water emulsion being adjusted to about pH 7.4 to 7.6 with sodium hydroxide.

7. The spin finish of claim 6 wherein the white mineral oil has a viscosity of about 375 S.U.S. at 100° F.

8. The spin finish of claim 6 wherein the polyoxyethylene oleyl phosphate contains about 7 moles of ethylene oxide per mole of polyoxyethylene oleyl phosphate.

9. The spin finish of claim 6 wherein the oil in water emulsion contains about 20 percent by weight of said oil portion.

10. A spin finish particularly for continuous filament polyamide yarn to be processed into twist plied tire cord, said finish being an oil in water emulsion of about 15 to 20 percent by weight of said oil portion, said oil portion consisting essentially of about 6 parts by weight of an oxidized polyethylene wax having an average molecular weight between about 1,000 and about 3,000 and containing 3 to 9 percent of oxygen by weight; about 47 parts by weight of white mineral oil having a viscosity of 375 S.U.S. at 100° F.; about 45 parts by weight of a polyoxyethylene oleyl phosphate; and about 2 parts by weight of a sulfonated succinic acid ester of decyl alcohol, said oil in water emulsion being adjusted to about pH 7.4 to 7.6 with sodium hydroxide.

* * * * *